US006848823B2

(12) United States Patent
King et al.

(10) Patent No.: US 6,848,823 B2
(45) Date of Patent: Feb. 1, 2005

(54) METHOD OF MIXING VISCOUS FLUIDS

(75) Inventors: David Marshall King, Ridgecrest, CA (US); Ronnald Brian King, Spokane, WA (US); Thomas Arnold Martin, Ridgecrest, CA (US)

(73) Assignee: Site-b Company, Spokane, WA (US)

( * ) Notice: Subject to any disclaimer, the term of this patent is extended or adjusted under 35 U.S.C. 154(b) by 0 days.

(21) Appl. No.: 10/360,066

(22) Filed: Feb. 6, 2003

(65) Prior Publication Data

US 2003/0112700 A1 Jun. 19, 2003

Related U.S. Application Data

(63) Continuation of application No. 10/199,687, filed on Jul. 18, 2002, now Pat. No. 6,543,927, which is a continuation of application No. 09/821,538, filed on Mar. 28, 2001, now Pat. No. 6,431,741, which is a continuation of application No. 09/686,144, filed on Oct. 10, 2000, now Pat. No. 6,257,753, which is a continuation of application No. 09/556,594, filed on Apr. 21, 2000, now Pat. No. 6,193,405, which is a continuation of application No. 09/091,145, filed as application No. PCT/US96/19345 on Dec. 5, 1996, now Pat. No. 6,062,721, which is a continuation of application No. 08/567,271, filed on Dec. 5, 1995, now abandoned.

(51) Int. Cl.[7] ..... B01F 5/12; B01F 7/32

(52) U.S. Cl. ..... 366/129; 366/265; 366/317; 366/605

(58) Field of Search ..... 366/129, 130, 366/262, 263, 265, 270, 315, 316, 317, 342, 343, 348, 605; 416/178, 184, 187

(56) References Cited

U.S. PATENT DOCUMENTS

| | | | | | |
|---|---|---|---|---|---|
| 59,493 | A | * | 11/1866 | Willcox | 366/343 |
| 444,345 | A | * | 1/1891 | Gabbett | 366/265 |
| 612,317 | A | * | 10/1898 | Dundon | 366/263 |
| 1,067,007 | A | * | 9/1913 | Douglas | 366/343 |
| 1,084,210 | A | * | 1/1914 | Howard | 366/302 |
| 1,765,386 | A | * | 6/1930 | Wait | 366/265 |
| 1,908,002 | A | * | 5/1933 | Valentine | 366/265 |
| 2,045,919 | A | * | 6/1936 | Parraga | 366/305 |
| 2,190,896 | A | * | 2/1940 | Underwood | 366/265 |
| 2,226,470 | A | * | 12/1940 | McGuffee | 366/343 |
| 2,230,146 | A | * | 1/1941 | Myers | 366/172.1 |
| 2,244,814 | A | * | 6/1941 | Underwood | 366/265 |
| 2,244,815 | A | * | 6/1941 | Underwood | 366/262 |
| 2,254,127 | A | * | 8/1941 | Underwood | 366/265 |
| 2,520,540 | A | * | 8/1950 | Green | 366/317 |
| 2,655,436 | A | * | 10/1953 | Bishop et al. | 422/225 |
| 2,724,547 | A | * | 11/1955 | Abbott et al. | 416/184 |
| 2,803,398 | A | * | 8/1957 | Sprouse | 416/187 |
| 2,879,044 | A | * | 3/1959 | Gunas | 416/185 |
| 3,166,303 | A | * | 1/1965 | Chapman | 366/129 |
| 3,319,940 | A | * | 5/1967 | Mentnech | 416/131 |

(List continued on next page.)

FOREIGN PATENT DOCUMENTS

| | | | |
|---|---|---|---|
| DE | 2225800 | * | 12/1972 |
| DE | 3245641 | * | 6/1984 |
| DE | 3616203 | * | 11/1987 |
| DE | 10134316 | * | 1/2003 |
| FR | 2385439 | * | 3/1977 |
| FR | 2605532 | * | 4/1988 |
| GB | 1064111 | * | 4/1967 |
| GB | 1206074 | * | 9/1970 |
| JP | 58-224637 | * | 12/1983 |
| WO | 97/20623 | * | 6/1997 |

*Primary Examiner*—Charles E. Cooley
(74) *Attorney, Agent, or Firm*—Weide & Miller, Ltd.

(57) ABSTRACT

A method of mixing viscous fluids is disclosed. The method comprises rotating a mixing apparatus (20) in a container (42) of fluid (44). The mixing apparatus comprises a cage (21) located at the end of the shaft (22). The cage (21) comprises a central circular disc (24) with an outer edge (43) and top (38) and bottom (40) sides. A number of vanes (26) extending from each side of the disc (24), the vanes (26) spacedly located near the outer edge of the plate. The free ends of the vanes (26) are connected by a hoop (38,40) to maintain their spaced relationship.

24 Claims, 3 Drawing Sheets

U.S. PATENT DOCUMENTS 3,362,689 A * 1/1968 Rothman et al. ..... 366/304
3,423,075 A * 1/1969 Knudsen et al. ..... 366/181.1
3,464,622 A * 9/1969 Dennis ..... 416/178
3,521,973 A * 7/1970 Schouw ..... 416/185
3,690,621 A * 9/1972 Tanaka et al. ..... 366/265
3,733,645 A * 5/1973 Seiler ..... 15/257.01
3,846,043 A * 11/1974 Wolbrink et al. ..... 416/183
3,942,770 A * 3/1976 Belouet et al. ..... 366/343
3,972,512 A * 8/1976 Grise et al. ..... 366/129
4,163,616 A * 8/1979 Claunch ..... 366/262
4,175,875 A * 11/1979 Van Horbek ..... 366/343
4,472,063 A * 9/1984 Eickelmann ..... 366/129
4,483,624 A * 11/1984 Bacon et al. ..... 366/293
4,538,922 A * 9/1985 Johnson ..... 366/318
4,738,593 A * 4/1988 Reifschneider ..... 416/178
4,893,941 A * 1/1990 Wayte ..... 366/265
4,900,159 A * 2/1990 Jamison ..... 366/343
4,948,262 A * 8/1990 Tome, Jr. ..... 366/129
5,073,033 A * 12/1991 Klepeis ..... 366/343
5,251,979 A * 10/1993 Larsen ..... 366/248
5,257,902 A * 11/1993 Atarashi et al. ..... 415/119
5,261,745 A * 11/1993 Watkins ..... 366/250
5,314,310 A * 5/1994 Bachellier ..... 416/201 A
5,417,493 A * 5/1995 Ericson ..... 366/343
5,865,539 A * 2/1999 Rogers ..... 366/325.8
5,938,332 A * 8/1999 Bachellier ..... 366/330.1
5,984,518 A * 11/1999 King et al. ..... 366/129
5,988,979 A * 11/1999 Wang ..... 416/178
6,062,721 A * 5/2000 King et al. ..... 366/129
6,068,395 A * 5/2000 Ondracek ..... 366/129
6,193,405 B1 * 2/2001 King et al. ..... 366/129
6,257,753 B1 * 7/2001 King et al. ..... 366/129
6,431,741 B2 * 8/2002 King et al. ..... 366/129
6,523,995 B2 * 2/2003 Fasano et al. ..... 366/264
6,543,927 B2 * 4/2003 King et al. ..... 366/129
2003/0107950 A1 * 6/2003 Shepherd et al. ..... 366/317

* cited by examiner

METHOD OF MIXING VISCOUS FLUIDS

RELATED APPLICATIONS

This application is a continuation of U.S. application Ser. No. 10/199,687, filed Jul. 18, 2002, now U.S. Pat. No. 6,543,927, which is a continuation of U.S. application Ser. No. 09/821,538, filed Mar. 28, 2001, now U.S. Pat. No. 6,431,741, which is a continuation of U.S. application Ser. No.09/686,144, filed Oct. 10, 2000, now U.S. Pat. No. 6,257,753, which is a continuation of U.S. application Ser. No. 09/556,594, filed Apr. 21, 2000, now U.S. Pat. No. 6,193,405, which is a continuation of U.S. application Ser. No. 09/091,145, filed Apr. 16, 1999, now U.S. Pat. No. 6,062,721, which was filed as International Application No. PCT/U596/19345, filed Dec. 5, 1996, which is a continuation of U.S. application Ser. No. 08/567,271, filed Dec. 5, 1995, now abandoned.

FIELD OF THE INVENTION

The present invention relates to a method of mixing fluids. More particularly, the present invention is a method of mixing viscous fluids by rotating a multi-vaned mixer.

BACKGROUND OF THE INVENTION

The mixing of viscous fluids has historically been a difficult task. Present methods of mixing such fluids often result in inadequate mixing and are time-consuming and energy consumptive.

One of the more common viscous fluids which must be mixed is paint. Homeowners and painters are all too familiar with the task of mixing paint.

Probably the most common method of mixing fluid such as paint involves the user opening the container, inserting a stir stick or rod and rotating or moving the stick about the container. This method is tiring, requiring tremendous effort to move the stir stick through the viscous fluid. Because of this, individuals often give up and stop mixing long before the paint is adequately mixed. Further, even if the individual moves the stir stick for a long period of time, there is no guarantee that the paint is thoroughly mixed, rather than simply moved about the container.

Many mechanisms have been proposed for mixing these fluids and reducing the manual labor associated with the same. These mechanisms have all suffered from at least one of several drawbacks: users have difficulty in using the device because of its complexity or size, the device inadequately mixes the fluid, the device mixes too slowly, the device does not break up or "disperse" clumped semi-solids in the fluid, and/or the user has a difficult time cleaning up the device after using it. Other problems associated with these mixers are that they often introduce air into the fluid (which, in the case of paint is detrimental, for example, when the paint is to be sprayed with a sprayer), and some of the mixing devices may damage the container in which the fluid is being mixed, causing the fluid to leak from the container.

One example of such a mechanized mixing device is essentially a "screw" or auger type device. An example of such a device is illustrated in U.S. Pat. No. 4,538,922 to Johnson. This device is not particularly effective in mixing such fluids, as it imparts little velocity to the fluid. Further, the device does not disperse clumped fluid material, but simply pushes it around the container.

Another method for mixing paint comprises shaking the paint in a closed container. This can be done by hand, or by expensive motor-driven shakers. In either instance, the mixing is time consuming and often not complete. Because the shaking occurs with the container closed, little air space is available within the container for the fluid therein to move about. Therefore, the shaking often tends to move the fluid very little within the container.

Several devices have been developed for mixing paint which comprise devices for connection to drills. For example, U.S. Pat. No. 4,893,941 to Wayte discloses a mixing device which comprises a circular disc having vanes connected thereto. The apparatus is rotated by connecting a drill to a shaft which is connected to the disc. This device suffers from drawbacks. First, the limited number of vanes does not provide for thorough mixing. Second, because the bottom disc is solid, no fluid is drawn through the device from the bottom. It is often critical that fluid from the bottom of the container be drawn upwardly when mixing viscous fluids, since this is where the heaviest of the fluids separate prior to mixing.

U.S. Pat. No. 3,733,645 to Seiler discloses a paint mixing and roller mounting apparatus comprising a star-shaped attachment. This apparatus is not effective in mixing paint, as it does not draw the fluid from the top and bottom of the container. Instead, the paddle-like construction of the device simply causes the fluid to be circulated around the device.

U.S. Pat. No. 1,765,386 to Wait discloses yet another device for mixing liquids. This device is wholly unacceptable, as it must be used in conjunction with a diverter plate located in the container to achieve adequate mixing. Use of the diverter plate would either require its installation into a paint container before being filled, which would increase the cost of paint to the consumer, or require that the consumer somehow install the device into a full paint container.

An inexpensive method for mixing viscous fluids in a quick and effective manner is needed.

SUMMARY OF THE INVENTION

The present invention is a method of mixing viscous fluids. The method comprises locating a mixing device in a container of fluid and rotating said device in said fluid with rotary drive means. The mixing device preferably comprises a mixing cage connected to the shaft.

The shaft is elongate, having a first end connected to a central plate and a second free end for connection to the rotary drive means. The plate is solid, circular, and has a top side, bottom side, and outer edge.

Vanes in the form of thin, curved slats, are spacedly positioned about the outer edge of each side of the plate. The vanes extend outwardly from each side of the plate parallel to the shaft. A first end of each vane is connected to the plate near the outer edge thereof. The vanes are connected at their second ends by a hoop.

The vanes preferably have a length which is between about 0.1–2 times the diameter of the plate. The number of vanes located about each side of the plate preferably number between 4 and 12 per inch diameter of the plate. Each vane preferably extends inwardly from the periphery of the plate no more than about 0.1–0.35 of the distance from the center of the plate to the periphery thereof at that location.

In use, a user positions the mixing cage of the device in a container of fluid. The user connects the free end of the shaft to the rotary drive means, such as a drill, and rotates the cage within the fluid.

The device has been found to be extremely effective in mixing viscous fluids such as paint. The device draws fluid, without the need of a diverter plate, from the top and bottom of the container. The fluid is dispersed at high velocity radially outwardly through vanes.

The device is easy to use, and a user need only connect it to a drill. The device is easy to clean, the user needing only to relocate it and rotate it in a container of cleaning fluid.

Further objects, features and advantages of the present invention over the prior art will become apparent from the detailed description of the drawings which follows, when considered with the attached figures.

DETAILED DESCRIPTION OF THE PREFERRED EMBODIMENT

The present invention comprises a method of thoroughly mixing a fluid with a mixing device. In general, the method comprises rotating the mixing device in a container containing fluid. As used herein, the term "fluid" is intended to mean liquids, especially those of viscous nature whether containing dissolved or undissolved solids, slurries, gels or those groupings of solid or semi-solid materials which behave in some respects as a fluid, such as granular materials (e.g. flour, sugar, sand, etc.).

Figure 1:
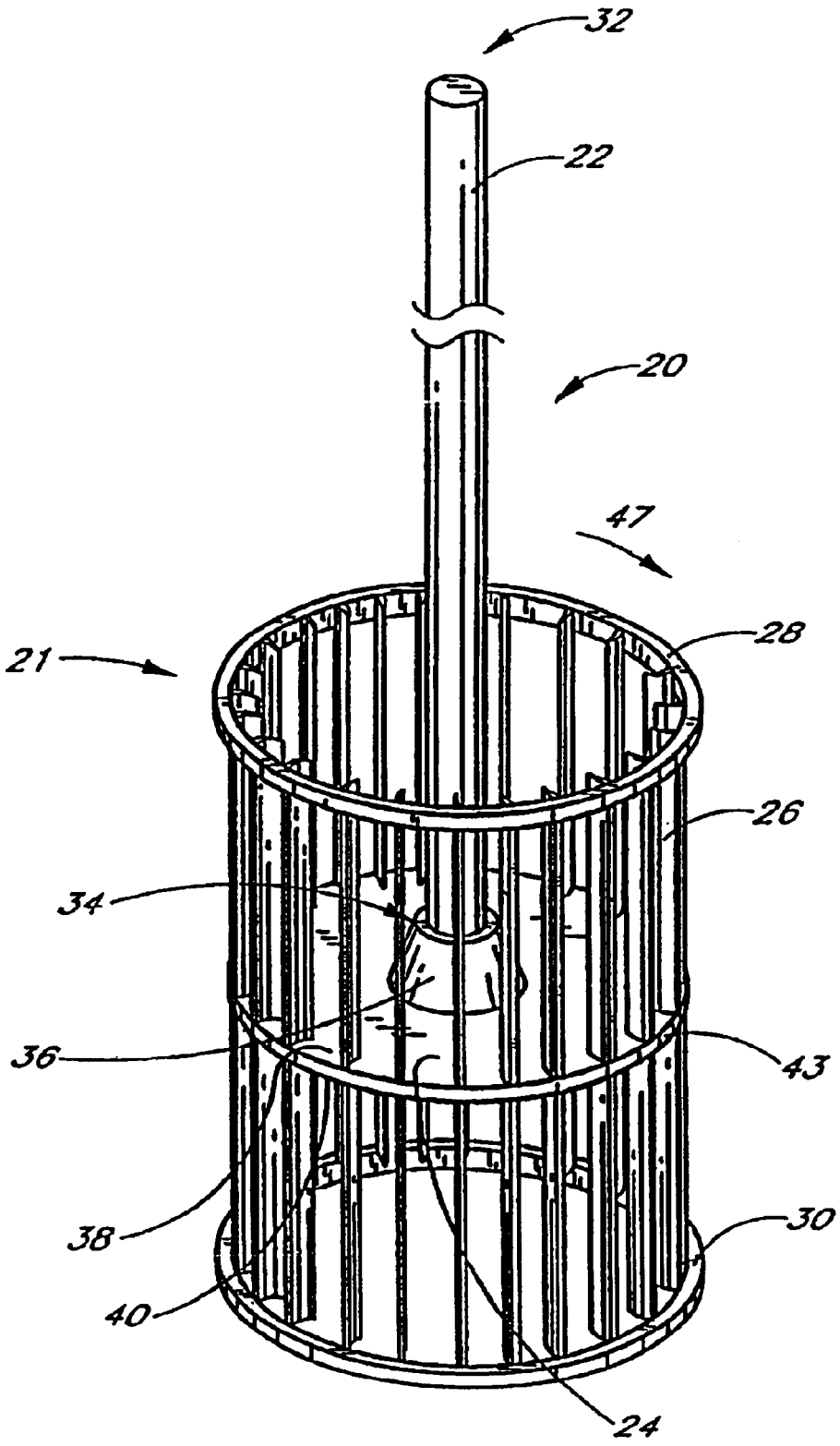
FIG. 1 is a perspective view of a mixing device in accordance with a first embodiment for use in the method of the present invention.
Figure 5:
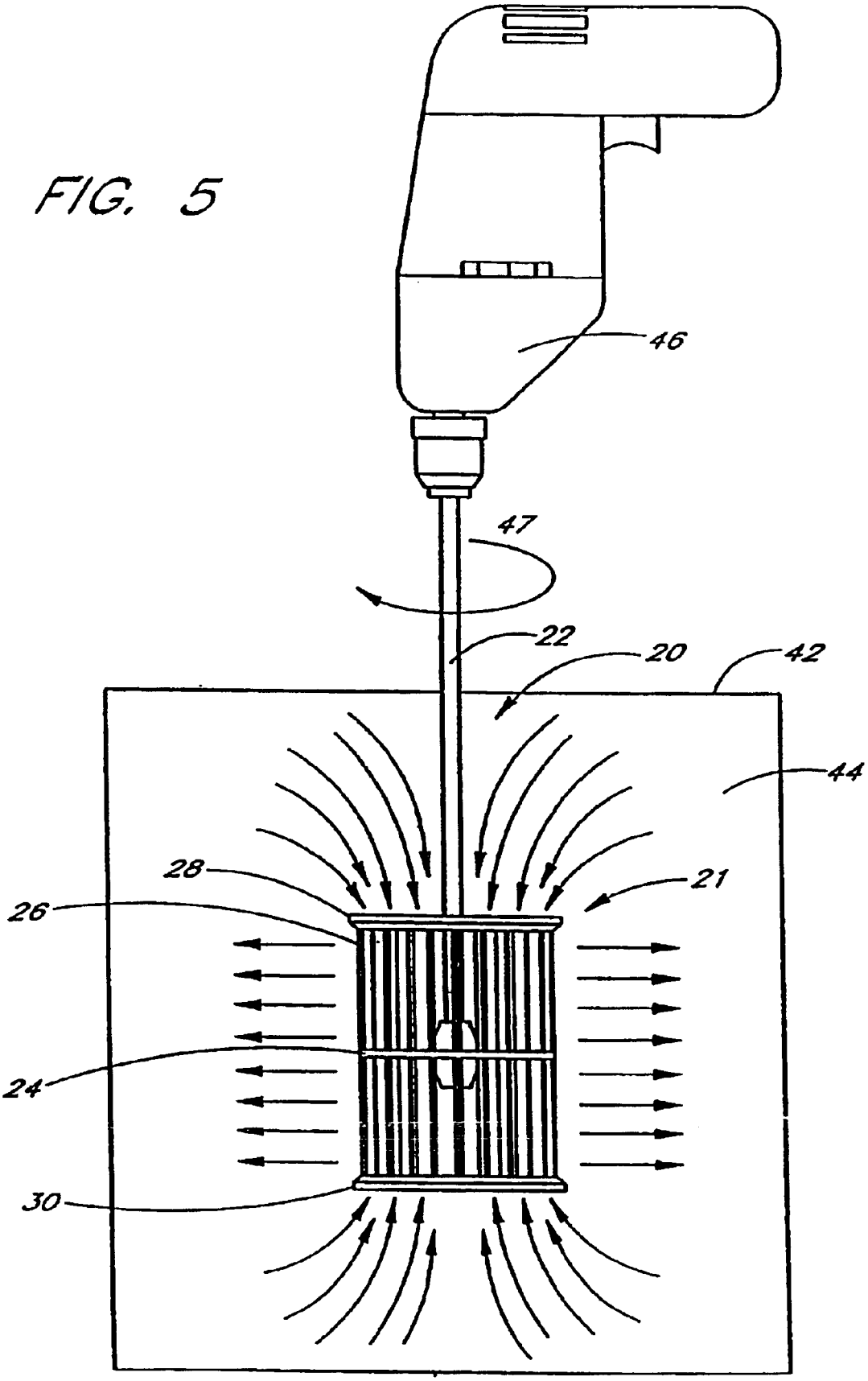
FIG. 5 illustrates use of the mixing device of FIG. 1 to mix a fluid in a container.

As illustrated in FIG. 1, the mixing device 20 generally comprises a cage-like structure having open ends. As illustrated in FIG. 5, the device 20 includes a shaft 22 for rotation by rotary drive means such as a drill 46, the shaft connected to a central plate connecting plate 24. Vanes 26 extend outwardly from each side of the central connecting plate 24 parallel to the shaft 22. The vanes 26 are connected at their ends opposite the plate by a hoop 28,30.

In use, a user positions the mixing device in a container 42 of fluid 44. The user connects the shaft 22 of the device 20 to a drill 46 and rotates it within the fluid. As illustrated in FIG. 5, the mixing device 20 mixes the fluid by drawing it from the top and bottom of the container 42 and forcing it radially outward through the vanes 26.

The mixing device 20 for use in the present invention will now be described with more particularity with reference to FIGS. 1–5. In general, and as illustrated in FIG. 1, the device 20 includes mixing cage 21 connected to a shaft 22, the mixing cage 21 comprising a central connecting plate 24, vanes 26, and two hoops 28, 30.

The shaft 22 is an elongate rigid member having a first end 32 and second end 34. The exact length and diameter of the shaft 22 depends on the depth of the fluid in the container to be mixed. When the device 20 is for use in mixing paint in a standard one-gallon paint can, the shaft 22 can be about 8–9 inches long and about 0.25 inches in diameter.

The first end 32 of the shaft 22 is adapted for connection to a rotary drive means. Preferably, the rotary drive means comprises a drill, as illustrated in FIG. 5. Preferably, the shaft diameter is chosen so that engagement with the rotary drive means is facilitated.

The second end 34 of the shaft 22 is connected to said central plate 24. Preferably, the second end 34 of the shaft 22 engages an adapter 36 connected to the plate 24. The shaft end 34 engages the plate 24 at the center point of the plate 24.

The central plate 24 comprises a flat, disc-shaped member having a top surface 38, bottom surface 40 and outer edge 43. The shaft 22 engages the plate 24 at the top surface 38 thereof.

Preferably, the plate 24 is constructed of durable and fairly rigid material. The plate 24 may be any of a variety of sizes and shapes. When used for batch mixing of quantities of one gallon of highly viscous (i.e. resists flow) liquids such as paint, it is preferably 1–4, and most preferably about 2.5 inches in diameter.

Figure 2:
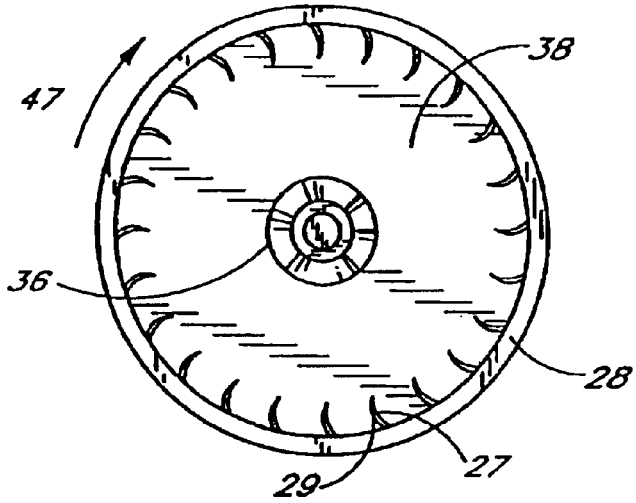
FIG. 2 is a top view of the mixing device of FIG. 1.
Figure 3:
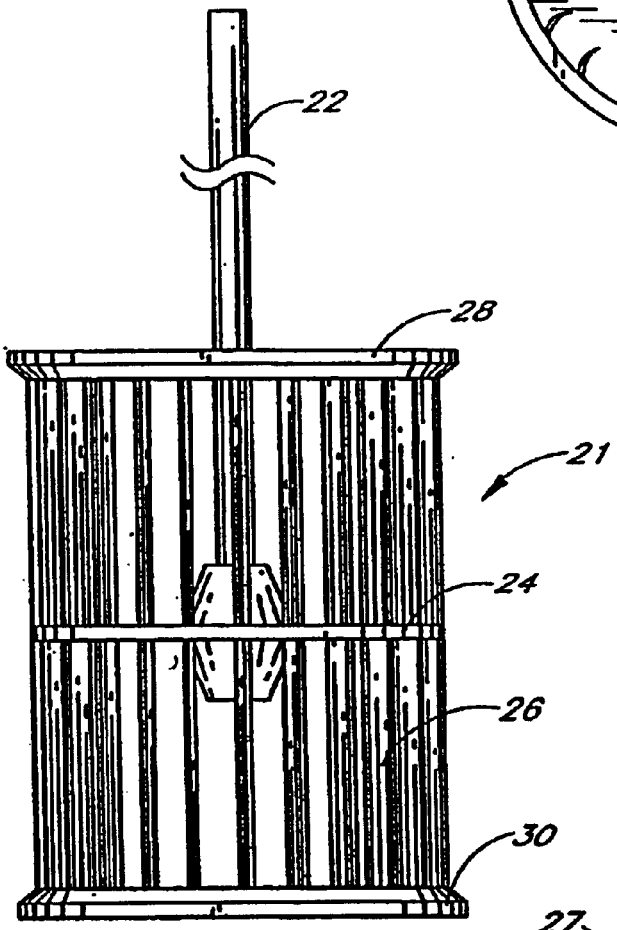
FIG. 3 is a side view of the mixing device of FIG. 1.

A number of vanes 26 extend from the top and bottom surface 38, 40 respectively, of the plate 24 or support near the outer edge 43 or periphery thereof. Each vane 26 has a first or inner edge and second or outer edge, being curved therebetween. As best illustrated in FIGS. 1 and 3, in one embodiment, although the vanes 26 are curved, the inner and outer edges thereof are generally aligned in a radial direction from the shaft 22 or an axis alone which the shaft extends. The curved shape of the vane 26 causes the vane to have a concave surface 27 and a convex surface 29 (see FIGS. 2 and 4). All of the vanes 26 are oriented on the plate 24 in the same direction. The vanes 26 are oriented on the plate 24 in a manner such that they face in the direction of rotation indicated by arrow 47 in FIGS. 1,2,4 and 5, when rotated by the rotational drive means 46. In the embodiment illustrated in FIGS. 1, 2 and 4, the first or inner edge of the vanes 26 generally faces the shaft 22 or axis along which the shaft 22 extends. Alternatively stated, as illustrated, the first or inner edge of each vane 26 defines a leading surface which is oriented generally perpendicular to a radial direction from the shaft 22 or the axis along which the shaft extends. Further, in an embodiment wherein the vanes 22 are curved, as best illustrated in FIGS. 1 and 3, adjacent vanes 26 define openings therebetween which are also generally curved. As illustrated, in one embodiment, at least a portion of one or more of these curved openings are generally radially aligned with the shaft 22 or the axis alone which the shaft extends.

The vanes 26 are preferably constructed of durable and fairly rigid material. It has been found preferable that the ratio of the length of the vanes 26 to the diameter of the plate be between about 0.1 and 2, and most preferably between 0.2 and 0.7. Moreover, it has been found preferable that the number of vanes 26 be dependent on the ratio of the diameter of the plate 24 on the order of about 4–12, and most preferably about 9 vanes per inch diameter of the plate 24. The width of each vane 26, is preferably no more than 0.1 to 0.35 times the radius of the plate 24, and more preferably about 0.1–0.3, and most preferably about 0.25 times the radius of the plate 24. The thickness of each vane 26 depends on the material from which it is made. Regardless of its width, each vane 26 is preferably positioned at the outer edge 43 of the plate 24 such that the vane 26 extends inwardly therefrom no more than about 0.1–0.35, more preferably less than about 0.3, and most preferably less than about 0.25, of the distance from the center of the plate 24 to the periphery thereof at that vane 26 location (i.e. less than about 0.35 the radius when the plate 24 is circular).

When the device 20 is configured for use in mixing paint in a one-gallon container and the plate 24 diameter is about 2.5 inches, the vanes 26 are preferably about 1 inch long from their ends at the connection to the plate 24 to their ends connected at the hoops 28, 30. Each vane 26 is preferably about 0.2–1, and most preferably about 0.3 inches wide.

Figure 4:
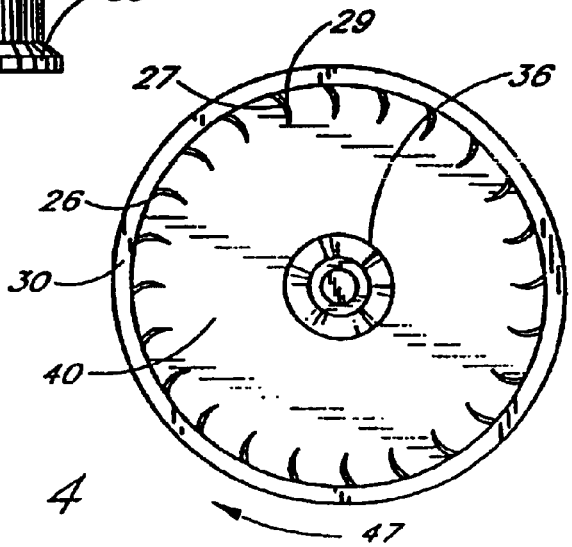
FIG. 4 is a bottom view of the mixing device of FIG. 1.

In order to disperse partially solidified particulate in the fluid, the vanes 26 are fairly closely spaced about the outer edge 43 of the plate 24. The vanes 26 are preferably spaced about 0.1–1 inch, and most preferably about 0.25 inches apart. When the vanes 27 are spaced far apart (e.g. about 1 inch) the vane width and/or height is preferably increased within the above-stated range or ratios. Thus, in the case where the plate 24 has a diameter of about 2.5 inches, there are preferably about twenty-four vanes 26, as illustrated in FIGS. 1, 2 and 4.

In order to prevent relative movement between the free ends of the vane 26, this end of each vane is connected to a support hoop 28,30. The hoop 28,30 comprises a relatively rigid circular member of "L" shaped cross-section. A first portion of each hoop 28,30 extends over the end of each of the vanes, and a second portion of each hoop 28,30 extends downwardly along the outer surface of each vane, as illustrated in FIGS. 2–4. In other embodiments, the hoops 28,30 may be configured and connected in other manners. Each vane 26 is securely connected to its corresponding hoop 28,30.

Use of the device 20 described above in the method of the present invention will now be described with reference to FIG. 5.

A user obtains a container 42 containing fluid 44 to be mixed. This container 42 may comprise a paint can or any other container. The fluid 44 to be mixed may comprise nearly any type of fluid, but the method of the present invention is particularly useful in mixing viscous fluids.

The user attaches the device 20 of the present invention to rotary drive means. As illustrated in FIG. 5, the preferred means comprises a drill 46. The means may comprise apparatus other than a drill, however, such as pulley or gas motor driven means. These drive means preferably turn the shaft 22 of the device at speed dependent upon the viscosity of the fluid. For example, for low viscosity fluids, the rotational speed may be often as low as about 500 rpm, while for high viscosity fluids the rotational speed may often be as high as 1,500 rpm or more. The user attaches the first end 32 of the shaft 22 to the drill 46, such as by locating the end 32 of the shaft in the chuck of the drill.

Once connected, the user lowers the mixing cage 21 into the fluid 44 in the container 42. The user locates the mixing cage 21 below the top surface of the fluid.

Once inserted into the fluid 44, the drill 46 is turned on, thus effectuating rotational movement of the mixing cage 21. While the cage 21 is turning, the user may raise and lower it with respect to the top surface of the fluid and the bottom of the container, as well as move it from the center to about the outer edges of the container, so as to accelerate the mixing of the fluid therein.

Advantageously, and as illustrated in FIG. 5, the device 20 of the present invention efficiently moves and mixes all of the fluid 44 in the container 42. In particular, because of the location of vanes extending from and separated by the central plate 24, the mixing cage 21 has the effect of drawing fluid downwardly from above the location of the cage 21, and upwardly from below the cage, and then discharging the fluid radially outwardly (as illustrated by the arrows in FIG. 5). This mixing effect is accomplished without the need for a diverter plate in the bottom of the container.

As indicated above, the fluid may or may not contain dissolved or undissolved solids. Most importantly, if partially solid material or particulate is present in the fluid, that material/particulate is effectively strained or dispersed by the vanes 26 of the cage 21. The close spacing of the vanes 26 traps unacceptably large undeformable globules of fluid or other solid or partially solid material in the cage, for removal from the cage after mixing. Other globules of partially solidified fluid material are sheared apart and dispersed when they hit the vanes, reducing their size and integrating them with the remaining fluid.

Advantageously, optimum mixing is achieved with the present device 20 as a result of the positioning of substantially long inner and outer vane edges at the periphery of the plate 24. This allows the fluid moving though the device 20 to impact upon the inner edge of the vane 26 at a high radial velocity and therefore with great force. Further, the outer edge of the vane has a high velocity in relation to the fluid in the container positioned outside of the device 20, thereby impacting upon that fluid with great force.

The ratio of the length of each vane to its width, and their placement at the periphery of the plate, creates maximum fluid flow through the cage 21. This is important, for it reduces the total time necessary to thoroughly mix the fluid in a particular session.

Notably, the hoops, 28,30 protect the container from damage by the spinning vanes 26. This allows the user to be less careful in positioning the cage 21 in the container 42, as even if the cage 21 encounters the sides or bottom of the container, the cage is unlikely to damage the container.

Another advantage of the mixing device 20 of the present invention is that it mixes the fluid without introducing air into the fluid, as is a common problem associated with other mixers utilized for the same purpose. As can be understood, the introduction of air into a fluid such as paint is extremely detrimental. For example, air within paint will prevent proper operation of many types of paint sprayers and makes uniform coverage when painting difficult. The presence of air is also detrimental, for example, where a polyurethane coating is being applied, as air bubbles become trapped in the coating and ruin its appearance.

After the fluid has been adequately mixed, cleaning of the device 20 is fast and easy. A user prepares a container filled with a cleaning agent. For example, in the case of latex paints, water is an effective cleaning agent. The user lowers the cage 21 into the cleaning agent, and turns on the drill 46. The rapid movement of the cleaning agent through the cage 21 causes any remaining original fluid (such as paint) or trapped globules thereon to be cleansed from the device 20.

Once the device 20 is clean, which normally only takes seconds, the device can be left to air dry.

The dimensions of the device 20 described above are preferred when the device is used to mix fluid in a container designed to hold approximately 1 gallon of fluid. When the device 20 is used to mix smaller or larger quantities of fluid of similar viscosity, the device 20 is preferably dimensionally smaller or larger.

While the vanes 26 of the device 20 are preferably curved, it is possible to use vanes which are flat. The vanes 26 are preferably curved for at least one reason, in that such allows the vanes 26 to have an increased surface area without extending inwardly from the periphery towards the center of the plate 24 beyond the preferred ratio set forth above. Also, it is noted that while the vanes 26 extending from the top and bottom of the plate 24 are preferably oriented in the same direction, they may be oriented in opposite directions (i.e. the convex surfaces of the top and bottom sets of vanes 26 may face opposite directions).

In an alternate version of the invention, vanes only extend from one side of the plate. The vanes may extend from either the top or the bottom side. Such an arrangement is useful when mixing in shallow containers, while retaining the advantages of high fluid flow mixing rates and the straining capability. In this arrangement, or that where the vanes 26 do not extend from each side the same distance, it will be appreciated that the central plate 24 is not "central," but still provides the supporting functions described.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of mixing fluid comprising:

isolating a fluid to be mixed in a container;

providing a mixing structure comprising a shaft, a support mounted to said shaft for rotation therewith, said shaft extending along an axis, a number of vanes mounted for rotation with said support and extending outwardly from said support, said vanes having a length and a width, said length greater than said width, said vanes having an inner edge and an outer edge, said vanes having a top end and a bottom end, said top ends of said vanes arranged in a generally circular configuration and said bottom ends of said vanes arranged in a generally circular configuration, said vanes generally defining at least a portion of an interior area of said mixing device, at least a portion of said inner edges of said vanes along the lengths thereof generally facing inwardly towards said axis, said vanes spaced apart from one another and defining openings there between through which fluid may flow, at least a portion of one or more of said openings generally radially aligned with said axis;

connecting said shaft to a rotary drive device;

positioning said structure in said container containing fluid to be mixed;

rotating said mixing structure within said fluid within said container by rotating said shaft with said rotary drive device;

drawing fluid from an area exterior to said mixing structure into said interior area of said mixing structure;

moving fluid drawn into said interior area towards said inner edges of said vanes at a high velocity;

expelling said fluid from said interior area of said mixing structure to said area exterior thereof through said vanes;

shearing said fluid as it impacts said inner edges of said vanes and passes through said openings between said vanes, dispersing particles which may be present in said fluid.

2. The method in accordance with claim 1 including the step of providing one or more of said vanes in a width between at least a portion of said inner and outer edges of about 0.3 times a distance from said axis to said outer edge of said vane.

3. The method in accordance with claim 1 including the step of trapping at least some material in said fluid which was not dispersed.

4. The method in accordance with claim 1 including the step of accelerating said fluid from said interior of said mixing structure outwardly towards said vanes.

5. The method in accordance with claim 1 wherein said vanes are curved between their inner and outer edges and said openings between said vanes are curved.

6. The method in accordance with claim 1 including the step of impacting said outer edges of said vanes on the fluid at high velocity to further mix said fluid during said rotating step.

7. A method of mixing fluid comprising:

isolating a fluid to be mixed in a container;

providing a mixing structure comprising a shaft, a support mounted to said shaft for rotation therewith, said shaft extending along an axis, a number of vanes mounted for rotation with said support and extending outwardly from said support, said vanes having a length and a width, said length greater than said width, said vanes having an inner edge and an outer edge, said vanes having a top end and a bottom end, said top ends of said vanes arranged in a generally circular configuration and said bottom ends of said vanes arranged in a generally circular configuration, said vanes generally defining at least a portion of an interior area of said mixing device, said vanes spaced apart from one another and defining openings there between, said openings defining flow paths from said interior area to an area exterior to said mixing structure, which openings and flow paths are generally radially aligned with said axis;

positioning said structure in said container containing fluid to be mixed; and rotating said mixing structure within said fluid within said container, drawing said fluid into said interior area, expelling said fluid generally radially outwardly at a high velocity through said generally radially aligned openings, dispersing solidified materials which may be present in said fluid by impacting said solidified materials upon said inner edges of said vanes with a high velocity and trapping undispersed materials if present in said fluid within said structure by lodging them between said vanes.

8. The method in accordance with claim 7 including the step of generally aligning at least a portion of said inner and outer edges of said vanes in a generally radial direction.

9. The method in accordance with claim 7 including the step of providing said vanes in a width between said inner and outer edges of about 0.3 times a distance from said axis to said outer edge of said support.

10. The method in accordance with claim 7 including the step of providing said vanes about 0.25 inches apart from one another.

11. The method in accordance with claim 7 including the step of providing vanes which are curved between said inner and outer edges.

12. The method in accordance with claim 7 including the step of providing said vanes in a number of between 4 and 12 vanes per inch diameter of said support when said support has an outer edge which is generally circular in shape.

13. The method in accordance with claim 7 wherein said inner edge of each vane defines a leading surface which is generally oriented perpendicular to a radial direction from said axis.

14. A method of mixing fluid comprising:

isolating a fluid to be mixed in a container;

providing a mixing structure comprising a shaft, a support having an outer edge and mounted to said shaft for rotation therewith, said shaft extending along an axis, said outer edge of said support located radially outward from said axis, a number of vanes mounted for rotation with said support and extending outwardly from said support, said vanes having a top end and a bottom end and a length and a width, said length greater than said width, said top ends of said vanes and said bottom ends of said vanes arranged in a generally circular configuration, said vanes having an inner edge and an outer edge, said vanes generally defining at least a portion of an interior area of said mixing structure, at least a portion of adjacent vanes spaced apart from one another in a non-overlapping configuration and defining an opening there between, said opening defining a flow path from said interior area to an area exterior to said mixing structure;

positioning said structure in said container containing fluid to be mixed; and rotating said mixing structure within said fluid within said container, drawing said fluid into said interior area, expelling said fluid generally radially outwardly at a high velocity through said openings, dispersing solidified materials which may be present in said fluid by impacting said solidified materials upon said inner edges of said vanes with a high velocity and trapping undispersed materials if present in said fluid within said structure by lodging them between said vanes.

15. The method in accordance with claim 14 including the step of generally aligning at least a portion of said inner and outer edges of said vanes in a generally radial direction.

16. The method in accordance with claim 14 including the step of providing said vanes in a width between said inner and outer edges of about 0.3 times a distance from said axis to said outer edge of said support.

17. The method in accordance with claim 14 including the step of providing said vanes about 0.25 inches apart front one another.

18. The method in accordance with claim 14 including the step of providing vanes which are curved between said inner and outer edges.

19. The method in accordance with claim 14 including the step of providing said vanes in a number of between 4 and 12 vanes per inch diameter of said support when said support has an outer edge which is generally circular in shape.

20. The method in accordance with claim 14 wherein said inner edge of each vane defines a leading surface which is generally oriented perpendicular to a radial direction from said axis.

21. A method of mixing fluid comprising:

isolating a fluid to be mixed in a container;

providing a mixing structure comprising a shaft, a support mounted to said shaft for rotation therewith, said shaft extending along an axis, a number of vanes mounted for rotation with said support and extending outwardly from said support generally parallel to said axis, said vanes having a length and a width, said length greater than said width, said vanes having an inner edge and an outer edge, said vanes having a top end and a bottom end, said top ends of said vanes arranged in a generally circular configuration and said bottom ends of said vanes arranged in a generally circular configuration, said vanes generally defining at least a portion of an interior area of said mixing structure, said vanes spaced apart from one another and defining openings there between, said openings defining flow paths from said interior area to an area exterior to said mixing structure, which openings and flow paths are generally radially aligned with said axis;

positioning said structure in said container containing fluid to be mixed; and rotating said mixing structure within said fluid within said container, drawing said fluid into said interior area, expelling said fluid radially outwardly at a high velocity through said radially aligned openings, dispersing solidified materials in said fluid moving at high radial velocity by impacting said solidified materials upon said inner edges of said vanes or trapping undispersed materials within said structure by lodging them between said vanes.

22. A method of mixing fluid comprising:

isolating a fluid to be mixed in a container;

providing a mixing structure comprising a shaft, a support having an outer edge and mounted to said shaft for rotation therewith, said shaft extending along an axis, said outer edge of said support located radially outward from said axis, a number of vanes mounted for rotation with said support and extending outwardly from said support generally parallel to said axis, said vanes having a top end and a bottom end and a length and a width, said length greater than said width, said top ends of said vanes and said bottom ends of said vanes arranged in a generally circular configuration, said vanes having an inner edge and an outer edge, said vanes generally defining at least a portion of an interior area of said mixing structure, adjacent vanes spaced apart from one another in a non-overlapping configuration and defining an opening there between, said opening defining a flow path from said interior area to an area exterior to said mixing structure;

positioning said structure in said container containing fluid to be mixed; and rotating said mixing structure within said fluid within said container, drawing said fluid into said interior area, expelling said fluid radially outwardly at a high velocity through said openings, dispersing solidified materials in said fluid moving at high radial velocity by impacting said solidified materials upon said inner edges of said vanes or trapping undispersed materials within said structure.

23. A method of mixing fluid comprising:

isolating a fluid to be mixed in a container;

providing a mixing structure comprising a shaft, a support mounted to said shaft for rotation therewith, said shaft extending along an axis, a number of vanes mounted for rotation with said support and extending outwardly from said support generally parallel to said axis, said vanes having a length and a width, said length greater than said width, said vanes having an inner edge and an outer edge, said vanes having a top end and a bottom end, said top ends of said vanes arranged in a generally circular configuration and said bottom ends of said vanes arranged in a generally circular configuration, said vanes generally defining at least a portion of an interior area of said mixing structure, said vanes spaced apart from one another and defining openings there between, said openings defining flow paths from said interior area to an area exterior to said mixing structure, which openings and flow paths are generally radially aligned with said axis;

positioning said structure in said container containing fluid to be mixed; and rotating said mixing structure within said fluid within said container, drawing said fluid into said interior area, expelling said fluid radially outwardly at a high velocity through said radially aligned openings, dispersing said solidified materials in said fluid moving at high radial velocity by impacting said solidified materials upon said inner edges of said vanes and, if said fluid contains undispersable solid or partially solid material, trapping said material within said structure by lodging them between said vanes.

24. A method of mixing fluid comprising:

isolating a fluid to be mixed in a container;

providing a mixing structure comprising a shaft, a support having an outer edge and mounted to said shaft for rotation therewith, said shaft extending along an axis, said outer edge of said support located radially outward from said axis, a number of vanes mounted for rotation with said support and extending outwardly from said support generally parallel to said axis, said vanes having a top end and a bottom end and a length and a width, said length greater than said width, said top ends of said vanes and said bottom ends of said vanes arranged in a generally circular configuration, said vanes having an inner edge and an outer edge, said vanes generally defining at least a portion of an interior area of said mixing structure, adjacent vanes spaced apart from one another in a non-overlapping configuration and defining an opening there between, said opening defining a flow path from said interior area to an area exterior to said mixing structure;

positioning said structure in said container containing fluid to be mixed; and rotating said mixing structure within said fluid within said container, drawing said fluid into said interior area, expelling said fluid radially outwardly at a high velocity through said openings, dispersing said solidified materials in said fluid moving at high radial velocity by impacting said solidified materials upon said inner edges of said vanes and, if said fluid contains undispersable solid or partially solid material, trapping said material within said structure.

* * * * *